US005794110A

United States Patent [19]

Kasai et al.

[11] Patent Number: 5,794,110

[45] Date of Patent: Aug. 11, 1998

[54] IMAGE FORMING APPARATUS HAVING A SEMICONDUCTIVE TRANSFER BELT

[75] Inventors: Toshihiro Kasai; Masashi Takahashi, both of Kanagawa-ken; Minoru Yoshida, Tokyo, all of Japan

[73] Assignee: Kabushiki Kaisha Toshiba, Kawasaki, Japan

[21] Appl. No.: 559,464

[22] Filed: Nov. 15, 1995

[30] Foreign Application Priority Data

Nov. 30, 1994 [JP] Japan ..... 6-296594

[51] Int. Cl.[6] ..... G03G 15/01

[52] U.S. Cl. ..... 399/299; 399/303; 399/313

[58] Field of Search ..... 355/271, 212, 355/277; 399/299, 303, 318, 306, 312, 313, 310

[56] References Cited

U.S. PATENT DOCUMENTS 5,119,139 6/1992 Torisawa ..... 399/303 X
5,121,170 6/1992 Bannai et al. ..... 399/303

FOREIGN PATENT DOCUMENTS 49-621135 6/1974 Japan .
60-10625 3/1985 Japan .
5-127541 5/1993 Japan .

*Primary Examiner*—S. Lee
*Attorney, Agent, or Firm*—Foley & Lardner

[57] ABSTRACT

An image forming apparatus of the present invention includes a conveyer belt for conveying an image receiving medium toward an image carrier, an image transferring member for electrostatically transferring a developed image formed on the image carrier onto the image receiving medium conveyed by the conveyer belt by applying an electric charge through the back of the conveyer belt, and an adsorbing roller provided on the surface of the conveyer belt facing it for electrostatically adsorbing the image receiving medium to the conveyer belt. The electric resistance of the conveyer belt from a first position where the conveyer belt and the adsorbing roller are facing each other to a second position where the conveyer belt and the image carrier are facing each other is larger than the electric resistance between the image carrier and the image transferring member.

21 Claims, 8 Drawing Sheets

IMAGE FORMING APPARATUS HAVING A SEMICONDUCTIVE TRANSFER BELT

BACKGROUND OF THE INVENTION

1. Field of the Invention

The present invention relates to an image forming apparatus which transfers and forms developed images on image receiving media which are conveyed by a conveying means such as a semiconductive transfer belt, etc.

2. Description of the Related Art

In an image forming apparatus using a dry developing method, a developed image was so far transferred on an image receiving medium from a photoconductive body by applying electric charge to the image surface of an image receiving medium from its reverse side using a corona charger. However, there was a problem in this method in that transfer voltage applied during the transfer is as extremely high as 4–8 kV, which is dangerous and furthermore, ozone harmful to the human body is generated.

Further, as a method to form full color images, a transfer device using an insulating belt and a corona charger has been put in practical use, which conveys the image receiving medium so as to come in contact with four photoconductive bodies which are arranged horizontally. However, in this system, transfer voltage that is applied when transferring images is as extremely high as 4– 8 kV, which is dangerous and furthermore, ozone that is harmful to the human body is generated. In addition, there is a problem that a discharging device is required because the belt itself will be charged.

A transfer system which is capable of performing the transfer at 1–2 kV applied voltage with less ozone generation has been disclosed in, for instance, Japanese Patent Publication No. 60-10625. In this Patent Publication, a transfer device comprising conductive rollers and a semiconductive belt made of carbon dispersed insulating resin has been disclosed.

As described above, in the transfer device using a semiconductive belt, a spark discharge tends to occur locally in a conductive contact transfer charger because of the belt being semiconductive. As a result, there was a problem that transfer charge could not be applied uniformly and the transfer performance was deteriorated.

Further, as to a contact charger that is used to adsorb the image receiving medium electrostatically to a semiconductive transfer belt, there was a problem that the adsorbing performance is deteriorated because a conductive contact charger cannot provide the uniform electric charge to the image receiving medium.

Further, as to the adsorbing performance, the conductive register rollers have no problem regarding the adsorbing performance of the image receiving medium to a semiconductive belt at normal temperature and low humidity. However, there is a problem that because of a drop of electric resistance due to moisture adsorption of the image receiving medium under the high humidity environment, the electric charge from a contact charger flows to conducive register rollers through the image receiving medium and the adsorbing performance cannot be secured.

Further, there was also a problem that because of the transfer belt being semiconductive, the electric charge from a transfer charger acts on the adsorbing portion through the surface or the inside of the transfer belt, causing poor adsorbing.

Furthermore, there was also a problem that because of the transfer belt being semiconductive, the electric charge from a transfer charger leaked to a conductive portion contacting the transfer belt through the surface or the inside of the transfer belt and could not form an effective transfer electric field at the transfer portion, causing poor transfer.

SUMMARY OF THE INVENTION

It is an object of the present invention to provide an image forming apparatus which is capable of providing the electric charge stably to a semiconductive transfer belt, enabling a satisfactory and stable image transfer and preventing a dielectric breakdown of the semiconductive transfer belt.

The present invention will provide an image forming apparatus comprising means for forming a developed image on an image carrier; means facing the image carrier for conveying an image receiving medium toward the image carrier; means for electrostatically transferring the developed image onto the receiving medium conveyed by the conveying means by applying an electric charge through the back of the conveying means; and means, provided on the surface of the conveying means opposing the conveying means, for electrostatically adsorbing the image receiving medium to the conveying means, wherein the electric resistance of the conveying means from a first position where the conveying means and the adsorbing means face each other to a second position where the conveying means and the image carrier face each other is larger than the electric resistance between the image carrier and the transferring means.

DETAILED DESCRIPTION OF THE PREFERRED EMBODIMENTS

One embodiment of the present invention will be described with reference to the attached drawings in the following.

Figure 1:
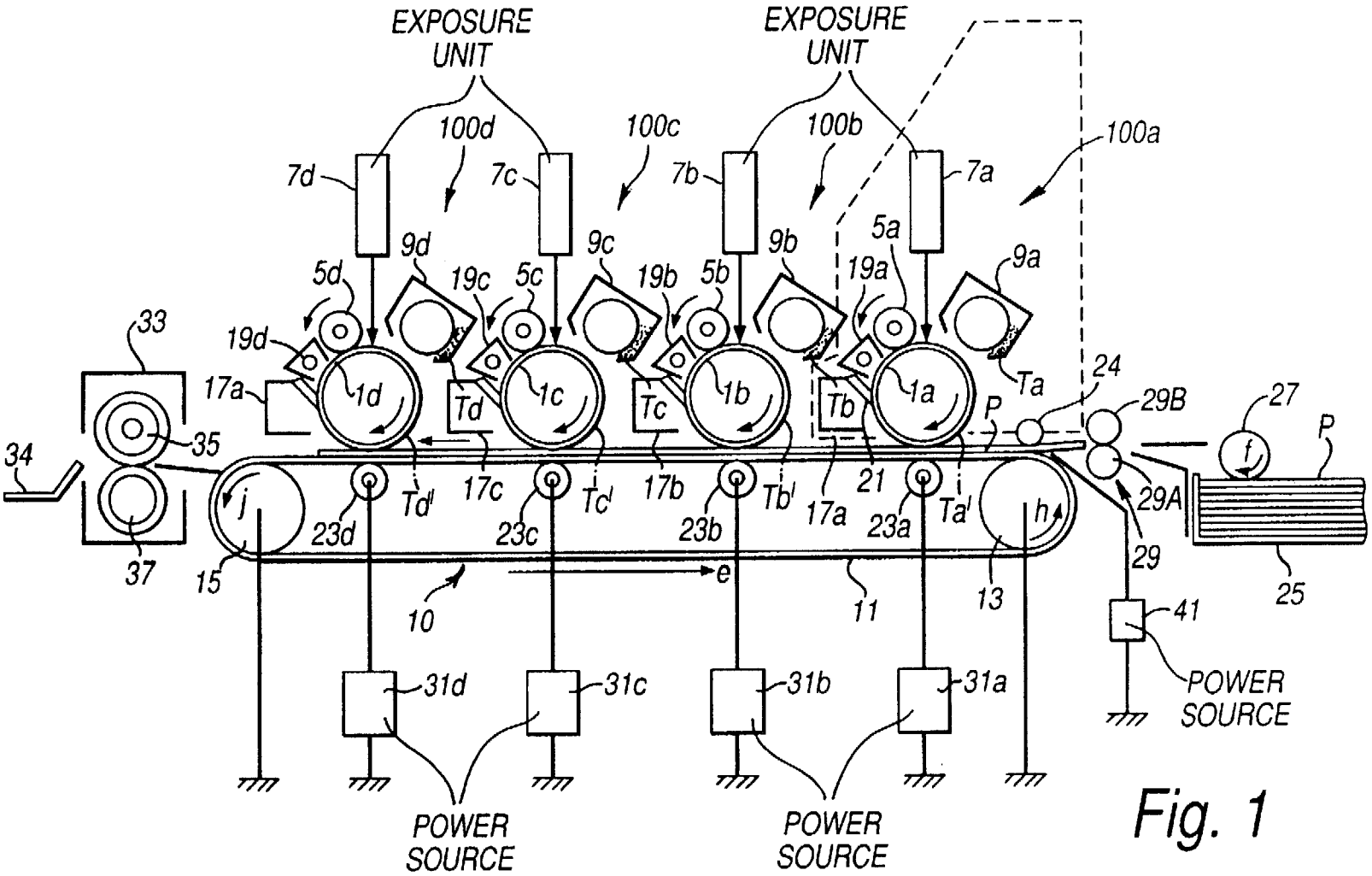
FIG. 1 is a schematic sectional view showing one embodiment of an image forming apparatus of the present invention.

FIG. 1 is a schematic sectional view of an image forming apparatus of the present invention. In FIG. 1, a photosensitive drum 1*a* as an image carrier is provided rotatably in the arrow direction as shown.

There are the following parts arranged around this photosensitive drum 1*a* along the rotational direction. That is, a charging roller 5a which is a means to uniformly charge the photosensitive drum 1a has been provided in contact with the surface of the photosensitive drum 1a. At the downstream side of the charging roller 5a, there is an exposure unit 7a provided, which is a means for forming an electrostatic latent image correspondng to an image on the charged photosensitive drum 1a. Further, downstream of the exposure unit 7a, there is a developing device 9a which is a means for storing a black toner Ta as a black developing powder and developing the electrostatic latent image to form a developed image with the black toner Ta. Downstream of the developing device 9a there is a conveying means 10 for conveying paper P, an image receiving medium, to the photosensitive drum 1a. This conveying means 10 will be described later.

Further, at the downstream side from the contacting position of the photosensitive drum 1a with paper P, a blade type cleaning device 17a which is a cleaning means and a discharging lamp 19a, which is a discharging means, are provided. The blade type cleaning device 17a is to remove the black toner Ta left on the photosensitive drum 1a after the transfer of a toner image Ta', a developed image, by scraping it by a blade 21.

Further, the discharging lamp 19a is to discharge the surface of the photosensitive drum 1a after the transfer. The discharging of the photosensitive drum 1a by this discharging lamp 19a completes one cycle of the image forming and in the next image forming the uncharged photosensitive drum 1a is charged again by the charging roller 5a.

The conveying means 10 is composed of an endless belt 11 which is a paper conveying member in width nearly equal to the width of the photosensitive drum 1a.

The belt 11 is put and stretched over a support roller 13 which is a paper conveying member supporting/driving member provided at the upstream side of the conveying path of paper P and a support roller 15 which is a paper conveying member supporting/driving member provided at the downstream side of the conveying path. The distance between the support rollers 13 and 15 is about 300 mm.

The belt 11 runs in the arrow direction e while being kept in contact with the support rollers 13 and 15 when the support rollers 13 and 15 rotate in the arrow directions h and j, respectively as shown. In this embodiment the moving speed of the belt 11 is 50 mm/s, which is a printing speed of 8 sheets/min. of A4 size paper.

Further, near the conveying means 10 in the construction as described above, there is a paper supply cassette 25 provided, which contains a number of sheets of paper P collectively, and the top sheet of paper P is taken out one sheet at a time by a pick-up roller 27 while rotating in the arrow direction f.

When the leading edge of the taken out paper P runs against a resister roller pair 29 kept stopped, which is comprised of a down roller 29A and an upper roller 29b, provided at this side of the conveying means 10, the pick-up roller stops after rotating continuously for a time until the leading edge slightly deflects. The leading edge of the paper P is properly positioned.

Further, the register roller pair 29 starts to rotate and sends out paper P to the conveying means 10 at a timing so that the leading edge of the toner image Ta' formed on the photosensitive drum 1a comes at the leading edge of paper P.

The sent out paper P is conveyed to an adsorbing roller 24 which is an elastic adsorbing means provided at a position opposite to the support roller 13 with the belt 11 pinched. A carbon dispersed urethane rubber roller of a diameter of 10 mm has been used for this adsorbing roller 24.

Voltage is supplied to the adsorbing roller 24 from a power source 41. Applied voltage is −1.5 kV. As higher voltage is applied for adsorbing, more electric charge to the belt 11 is provided and the adsorbing force increases accordingly. However, the withstanding voltage of the belt 11 is limited (about 3 kV, maximum).

The adsorbing roller 24 rotates following the movement of the belt 11 or paper P. At the same time when paper P is conveyed to the position where the adsorbing roller 24 is arranged, bias voltage is applied to the adsorbing roller 24. Thus, the surface of paper P is charged negatively and the opposite side of the belt 11 is charged positively. The paper P is adsorbed to the belt 11 by the electrostatic force by this charge.

Further, a process unit 100a for black color is composed of the photosensitive drum 1a, charging roller 5a, exposure unit 7a, developing device 9a, cleaning device 17a and discharging lamp 19a described above.

Further, a process unit 100b for forming yellow images, a process unit 100c for forming magenta images and a process unit 100d for forming cyan images have been arranged in order along the paper P conveying direction at corresponding positions between the support rollers 13 and 15 on the belt 11 in addition to the black color process unit 100a.

As the basic construction of these yellow process unit 100b, magenta process unit 100c and cyan process unit 100d are the same as the black process unit 100a, the symbol a is changed to b for yellow, c for magenta and d for cyan and the detailed explanation will be omitted.

Paper P conveyed by the belt 11 is brought in contact with the photosensitive drums 1a, 1b, 1c and 1d successively. Near the contacting positions of the paper P with the photosensitive drums 1a, 1b, 1c and 1d, transfer rollers 23a, 23b, 23c and 23d, which are bias voltage applying means and transfer means, have been provided corresponding to the photosensitive drums 1a, 1b, 1c and 1d, respectively.

That is, the transfer rollers 23a, 23b, 23c and 23d have been provided in contact with the back of the belt 11 near the positions where the corresponding photosensitive drums 1a, 1b, 1c and 1d are in contact with the belt 11 and are opposing the photosensitive drums 1a, 1b, 1c and 1d, respectively via the belt 11.

Further, these transfer rollers 23a, 23b, 23c and 23d rotate following the running of the belt 1 and are connected to bias power sources 31a, 31b, 31c and 31d, respectively.

Here, the image forming process of the image forming apparatus in the construction as described above will be described. First, the rotating photosensitive drums 1a, 1b, 1c and 1d of the four process units 100a, 100b, 100c and 100d are charged uniformly to about 500 V by charging rollers 5a, 5b, 5c and 5d.

The laser beam is applied from the exposure unit 7a to the photosensitive drum 1a which has been uniformly charged by the charging roller 5a and an electrostatic latent image is formed corresponding to an image of an original document. This electrostatic latent image is developed by the sufficiently pre-charged black toner Ta in the developing device 9a and a black toner image Ta' is formed on the photosensitive drum 1a.

Also, a yellow toner image Tb', magenta toner image Tc' and cyan toner image Td' are formed on the photosensitive drums 1b, 1c and 1d of the yellow process unit 100b, magenta process unit 100c and cyan process unit 100d similarly.

On the other hand, paper P is taken out of the paper supply cassette 15 by the pick-up roller 27 and sent to the register roller pair 29. The register roller pair 29 times to the rotation of the photosensitive drum 1*a* so that the leading edge of the toner image Ta' comes to the leading edge of the paper P and sends out the paper P on the belt 11.

Then, the sent out paper P is adsorbed to the belt 11 by the action of the adsorbing roller 24 and conveyed to the transfer position. When the paper P is conveyed to the transfer position, electric charge is applied to the belt 11 from the transfer rollers 23*a*, 23*b*, 23*c* and 23*d* connected to the power sources 31*a*, 31*b*, 31*c* and 31*d* successively. A transfer electric field is successively formed between the photosensitive drums 1*a*, 1*b*, 1*c* and 1*d* and the belt 11 by the electric charge applied to the belt 11.

So, the black toner image Ta' on the photosensitive drum 1*a* is first transferred on the paper P. The paper P carrying this black toner image Ta' is conveyed to the photosensitive drum 1*b*. The yellow toner image Tb' formed on the photosensitive drum 1*b* is transferred over the formerly transferred black toner image Ta'. The paper P is further conveyed to the photosensitive drums 1*c* and 1*d* and the magenta toner image Tc' and the cyan toner image Td' are transferred over the formerly transferred black and yellow toner images.

The paper P carrying a color toner image formed through multiple transfers as described above is separated from the belt 11 at the position corresponding to the support roller 15, set to a fixer 33 which is a fixing means and passes through between a heat roller 35 and a pressure roller 37. At this time, the color toner image is fixed on the paper P while being kept in contact with the heat roller 35. The paper P with the fixed color toner image is ejected on a receiving tray 34.

Here, the belt 11 which is used as the conveying means 10 will be described in detail.

For the belt 11, two functions are demanded; that is, to convey paper P that is an image receiving medium and to transfer toner images which are developed images. Hereinafter, the belt is referred to as the transfer belt 11.

This transfer belt 11 is composed of conductive carbon particles of 10% weight ratio and thermo-setting polyimide of 90% weight ratio. The seamless transfer belt 11 has been manufactured by the imidic reaction with these materials poured in a metal mold. The molded belt is in a ring shape of 270 mm in width, 668 mm in diameter and 100 μm in film thickness. Such resins as polycarbonate, polyethylene terephthalate, polytetrafluoroethylene (TEFLON), polyfluorovinylidene (PVDF), etc., and various synthetic polymer alloys may be used as basic materials of the belt. Further, the belt may be not only in the single layer structure but also in multiple layers structure.

Volume resistance of the transfer belt 11 needs to $10^8$–$10^{15}$ Ω.cm to be capable of performing the transfer by applying bias voltage. Further, it is preferable to use the transfer belt having a thickness of approximately 30–300 μm.

Electric resistance of this polyimide film with dispersed conductive carbon was measured. In this measurement, using a resistance measuring instrument manufactured by Mitsubishi Yuka Co, Ltd. (Commodity Name: Hiresta, Model HRSS Probe), 500 V was applied and resistances 10 seconds after the moment of application of the voltage were obtained. Both of volume resistance and surface resistance were obtained. The measurement was conducted according to the measuring manual. Further, the measurement was conducted under three environmental conditions: high temperature and humidity (30° C., 85% RH), normal temperature and humidity (21° C., 50% RH) and low temperature and humidity (10° C., 20% RH). The results of this measurement are shown in Table 1.

TABLE 1

Environmental Dependency of Resistance of Transfer Belt

| | Environment | | |
|---|---|---|---|
| Resistance | 30° C., 85% RH | 21° C., 50% RH | 10° C., 20% RH |
| Surface resist. (Ω/□) | $3 \times 10^{13}$ | $3 \times 10^{13}$ | $3 \times 10^{13}$ |
| Volume resist. (Ω · cm) | $3 \times 10^{13}$ | $3.2 \times 10^{13}$ | $4 \times 10^{13}$ |

From this Table 1, it is seen that the surface resistance is $3\times10^{13}$ Ω/□ regardless of the environmental conditions. Further, volume resistance is also $3$–$4\times10^{13}$ Ω.cm regardless of the environmental conditions and does not vary much.

Next, the transfer roller 23 as a transfer means will be described in detail.

This transfer roller 23 (a general term for the rollers 23*a*, 23*b*, 23*c* and 23*d*) has a function to supply the electric charge for electrostatically transferring the toner image T' (a general term for the toner images Ta', Tb', Tc' and Td') on the photosensitive drum 1 (a general term for the photosensitive drums 1*a*, 1*b*, 1*c* and 1*d*) on paper P conveyed by the transfer belt 11.

At first, when tests were conducted using metallic rollers as the transfer rollers, the electric discharge was unstable and was turned to the spark discharge and therefore, the transfer belt 11 could not be charged uniformly, generating many poor transfers. This is considered because stable nip for stable discharge couldn't be obtained from solid metallic rollers. Further, the dielectric breakdown was caused on the transfer belt due to the abnormal discharge and it became impossible to apply voltage.

So, it was decided to use conductive rubber rollers which are more resistive and elastic than metallic rollers. Definitely, urethane rubber rollers with carbon dispersed were used. This urethane rubber roller is made of a metallic shaft 6 mm in diameter with a 3 mm thick urethane rubber wound round it and the rubber hardness of JIS-A standard is 60 degree. To form the stable nip described above, 25 to 65 degree are the proper hardness of this rubber. If the rubber is softer than this hardness, a permanent strain may be produced. Further, resistance is $4\times10^4$ Ω.

Figure 2:
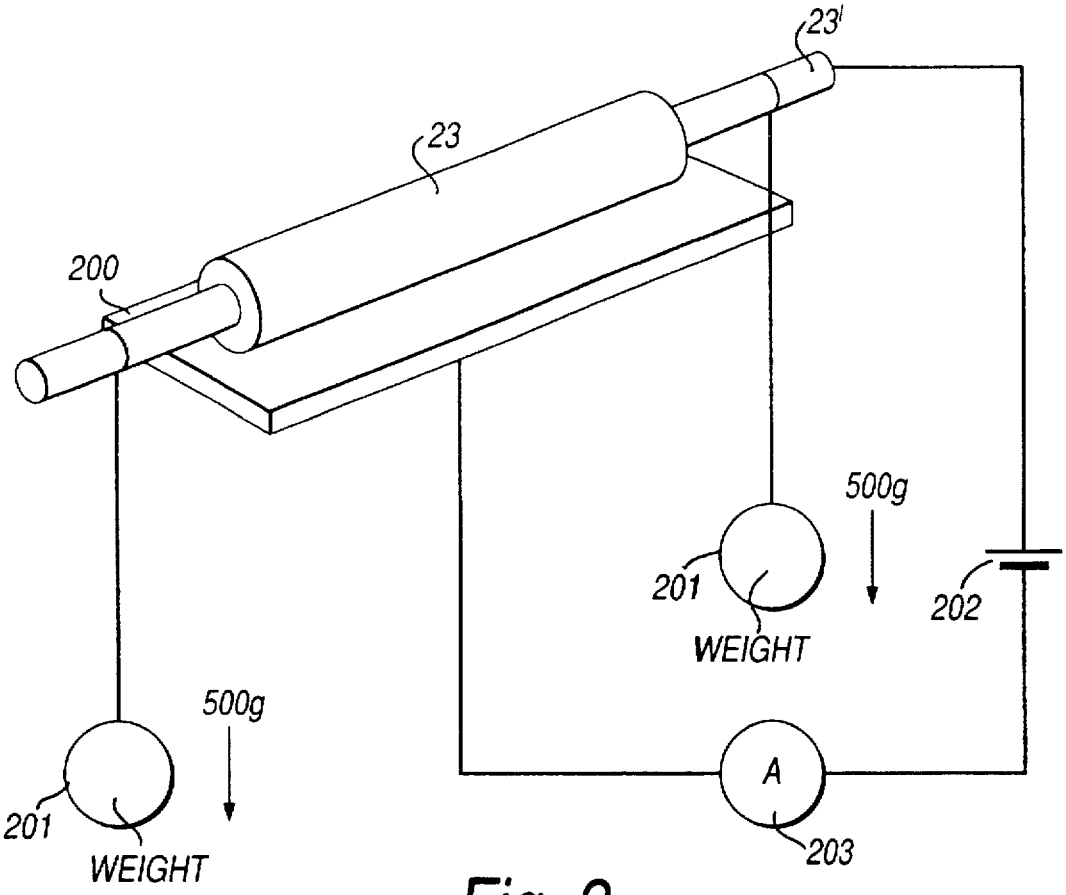
FIG. 2 is an electric circuit for measuring resistance of transfer rollers.

As to a resistance measuring method, a 500 g weight 201 was suspended from both sides of the metallic shaft 23' of the transfer roller 23, the transfer roller 23 was kept in contact with a metallic flat plate 200 and applying voltage 202 between the metallic shaft 23' and the metallic flat plate 200, resistances were obtained by measuring currents with an ammeter 203 as shown in FIG. 2.

When such urethane rubber rollers have been adopted in the image forming apparatus shown in FIG. 1 as the transfer rollers, multiple transfer tests were conducted using ordinary PPC paper as image receiving media.

Various bias voltages were applied to four sets of the transfer rollers under three environmental conditions; high temperature and humidity (30° C., 85% RH), normal temperature and humidity (21° C., 50% RH) and low temperature and humidity (10° C., 20% RH) and multi-transfer characteristics were evaluated with the results as shown in Table 2.

TABLE 2

| Multi-Transfer Characteristics | | | |
|---|---|---|---|
| ENVIRONMENT | 30° C., 85% RH | 21° C., 50% RH | 0° C., 20% RH |
| TONER IMAGE DENSITY LEFT ON PHOTOSENSITIVE DRUM AFTER TRANSFER | | | |
| 1ST STATION | 0.25 | 0.26 | 0.25 |
| 2ND STATION | 0.26 | 0.28 | 0.28 |
| 3RD STATION | 0.21 | 0.20 | 0.18 |
| 4TH STATION | 0.27 | 0.30 | 0.30 |
| IMAGE DENSITY ON PAPER P AFTER TRANSFER | | | |
| 1ST STATION | 1.42 | 1.42 | 1.44 |
| 2ND STATION | 1.42 | 1.41 | 1.20 |
| 3RD STATION | 1.85 | 1.72 | 1.53 |
| 4TH STATION | 1.42 | 1.52 | 1.42 |

This Table 2 shows the measured data of the toner image density left on the photosensitive drum and image density transferred on paper P with four sets of voltages applied to the transfer roller 23 changed when the toner image density left on the drum was most low and the transferred image density on the paper was high.

The conditions for applying transfer bias voltage at the time of measurement were as follows: the first transfer bias voltage (the output voltage of the bias power source 31*a*) was 1,200 V, the second transfer bias voltage (the output voltage of the bias power source 31*b*) was 1,250 V, the third transfer bias voltage (the output voltage of the bias power source 31*c*) was 1,300 V and the fourth transfer bias voltage (the output voltage of the bias power source 31*d*) was 1,400 V. At the time, the spark discharge that is an abnormal discharge from the transfer roller 23 was riot recognized and the poor transfer was also not generated.

Then, using the transfer roller 23 with reduced conductive carbon content and a resistance of $10^{10}$ Ω, the multi-transfer characteristic was evaluated similarly. The resistance measuring method is the same as the method described above. As a result, to give the electric charge needed for the transfer to the transfer belt 11, it was required to apply a considerably high voltage to the transfer roller 23 having a resistance of $10^{10}$ Ω. Definitely, about 3,000 V was needed for the fourth transfer bias voltage. The partially poor transfer was recognized on the multi-transfer image at this time.

This is because the discharge was taking place on the only portion of the surface of the transfer roller 23, which was fit to the discharge condition as the resistance of the transfer roller 23 increased too high. From this result, this resistance was considered the upper limit.

Next, tests were conducted in connection with the optimum resistance of the adsorbing roller 24.

Figure 3:
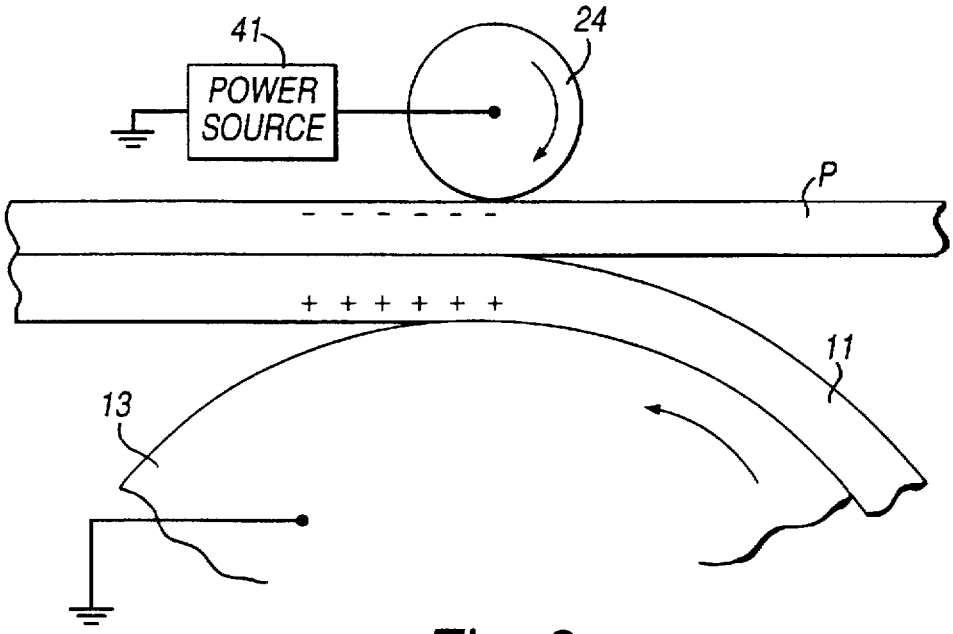
FIG. 3 is a schematic side view for explaining the adsorbing motion of transfer paper to a transfer belt.

The electrostatic adsorbing force of paper P will be explained referring to FIG. 3. The paper P put between the transfer belt 11 and the adsorbing roller 24 is charged negatively as a result of the discharge by the adsorbing roller 24 connected to the power source 41. As a result of this discharge, plus charge is supplied to the transfer belt 11 from the support roller 13 and the paper P is electrostatically adsorbed by the transfer belt 11.

At first, this adsorbing roller also used a metal roller 10 mm in diameter. However, as the charge holding capacity of the paper P from the adsorbing roller 24 connected to the bias power source becomes low under the humid environment, a phenomenon was observed that the electrostatic adsorbing forces of the transfer belt 11 and the paper P decreased.

To cope with this phenomenon, the attenuation of electric charge was compensated by increasing voltage applied to the adsorbing roller 24. As a result, applying voltage increased to higher than 2,000 V, the adsorbing roller 24 caused the abnormal discharge (the spark discharge) and the electric charge couldn't be applied uniformly to the paper P. Further, as a result of the abnormal discharge, the transfer belt 11 caused partial dielectric breakdown.

The cause for this dielectric breakdown is considered entirely the same as that caused on the transfer roller 23. That is, it is considered that the stable nip for the stable discharge is not obtainable from a solid metallic roller.

So, it was decided to adopt an elastic resistive roller for the adsorbing roller 24 likewise the transfer roller 23 to assure the stable discharge. A metallic bar 6 mm in diameter and 2 mm in thickness with carbon dispersed and resistance $10^4$ Ω was used as an adsorbing roller. As a result, it became possible to apply the sufficient electric charge to adsorb paper P by the transfer belt without causing the abnormal discharge (the spark discharge) even when high voltage was applied.

Then, providing an adsorbing roller 24 with conductive carbon content reduced to make resistance to $10^{10}$ Ω, the adsorbing performance of this roller 24 was evaluated similarly. The resistance measuring method was the same as the method described above. As a result, to give the electric charge required for adsorbing to paper P, it was required to apply a considerably high voltage to the adsorbing roller 24 having a resistance $10^{10}$ Ω. Definitely, about 3,000 V was needed. As to the adsorbing performance at this time, the poor adsorbing was partially recognized on paper P when it was in the raised state.

This is because the discharge was taking place on a portion which became fit to the surface discharge of the adsorbing roller 24 as the resistance of the adsorbing roller 24 increased too high. From this result, this resistance is considered the upper limit.

When the multi-transfer characteristic under the humid environment was evaluated, the adsorbing of paper P to the transfer belt 11 because unstable, causing a color misregistration of a multi-transferred image. So, the examination was conducted on the register roller pair. As to the force to adsorb paper P to the transfer belt 11, as described above, the support roller 13 is provided inside the transfer belt 11 and when the electric charge is given to the paper P from the adsorbing roller 24 facing the support roller 13 with the transfer belt 11 pinched between them, the electric charge in the polarity reverse to that from the adsorbing roller 24 is given to the transfer belt 11 from the support roller 13. By this electric charge, the electrostatic force acts to adsorb the paper P to the transfer belt 11 as shown in FIG. 3.

Drop of the adsorbing force is considered due to leakage of the electric charge given to the paper P and the transfer belt. So, the environmental dependency (humidity) of resistance of the transfer belt 11 and the paper P was evaluated.

Volume resistance of the transfer belt 11 is $3–4\times10^{13}$ Ω.cm and surface resistance is $3\times10^{13}$ Ω/□ regardless of the environmental conditions and much variance was not recognized as shown in Table 1.

On the contrary, volume resistances of the paper P changed as large as $3.3\times10^{11}$ Ω.cm at 10° C., 20% RH, $4.9\times10^{10}$ Ω.cm at 21° C., 50% RH and $6.0\times10^{7}$ Ω.cm at 30°

C., 85% RH depending upon environmental conditions as shown in Table 3.

TABLE 3

Environmental Dependency of Resistances of Paper

| Resistance | Environment 30° C., 85% RH | 21° C., 50% RH | 10° C., 20% RH |
|---|---|---|---|
| Surface resist. (Ω/□) | $1.0 \times 10^8$ | $2.2 \times 10^{10}$ | $3.0 \times 10^{12}$ |
| Volume resist. (Ω · cm) | $<6.0 \times 10^7$ | $4.9 \times 10^{10}$ | $3.3 \times 10^{11}$ |

Further, surface resistance also changes: $3.0\times10^{12}$ Ω/□ at 10° C., 20% RH, $2.2\times10^{11}$ Ω/□ at 21° C., 50% RH and $1.0\times10^{8}$ Ω/□ at 30° C., 85% RH as shown in Table 3.

Figure 4:
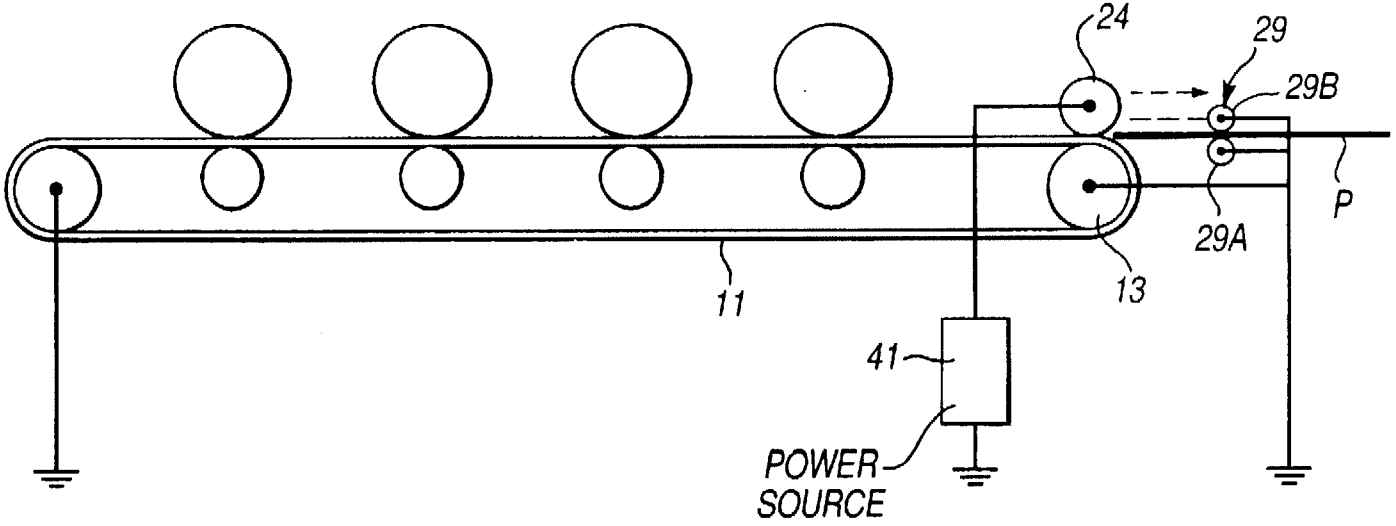
FIG. 4 is a schematic side view showing the flow of the electric charge in the adsorbing motion of transfer paper to a transfer belt.

From the above evaluation results, it is considered that the electric charge given to the paper P from the adsorbing roller 24 leaked through the register roller pair 29 which are conductive rollers, because of reduced resistance of the paper P itself. This state is shown in FIG. 4.

So, when the multi-transfer was conducted under the high humid condition using this register roller pair 29 as insulating rubber rollers, no color misregistration was recognized on a multi-transferred image. In other words, the paper P was positively adsorbed to the transfer belt 11.

Next, resistance of the transfer belt 11 was examined in detail.

Figure 5:
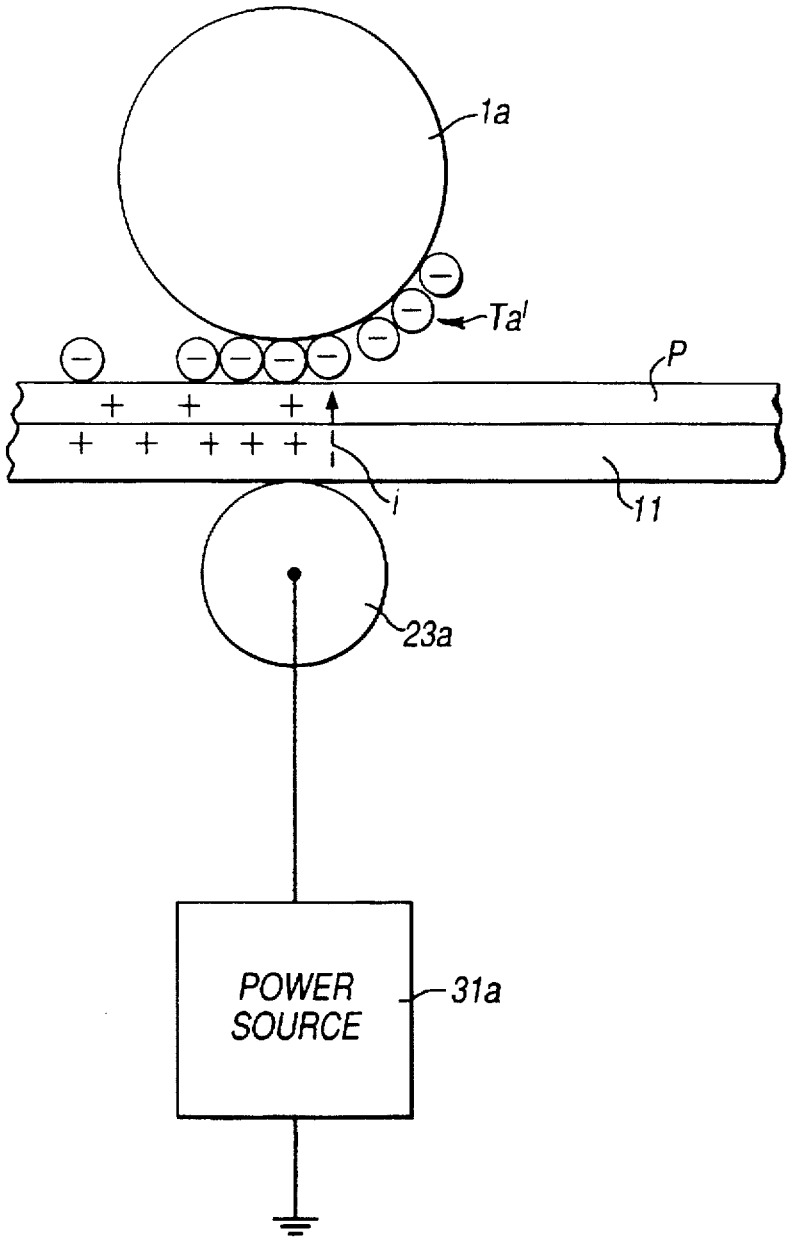
FIG. 5 is a schematic side view for explaining the transfer motion of a developed image to transfer paper from a photosensitive drum.

What must be taken into consideration as to resistance are electrostatic adsorbing and multi-transfer performance of the paper P. Here, the transfer performance will be examined referring to FIG. 5 showing an expanded first transfer station.

Paper P is pinched between the transfer roller 23*a* and the photosensitive drum 1*a* together with the transfer belt 11. Under this state, the power source 31*a* is connected to the transfer roller 23*a*. The discharge is taking place from the transfer roller 23*a* by the electric field that is formed by the transfer roller 23*a* and the photosensitive drum 1*a*. Discharge voltage (differing from discharge start voltage) at this time is 1,200 V.

When the discharge is taking place, the discharge current i flows to the photosensitive drum 1*a* through the transfer belt 11 and the paper P as illustrated. However, as resistance of the transfer belt 11 is as high as $10^{13}$ Ω.cm, the electric charge remains at the transfer belt 11. By the electric field formed by this electric charge and the photosensitive drum 1*a*, the toner image Ta' on the photosensitive drum 1*a* is transferred to the paper P electrostatically.

Figure 6:
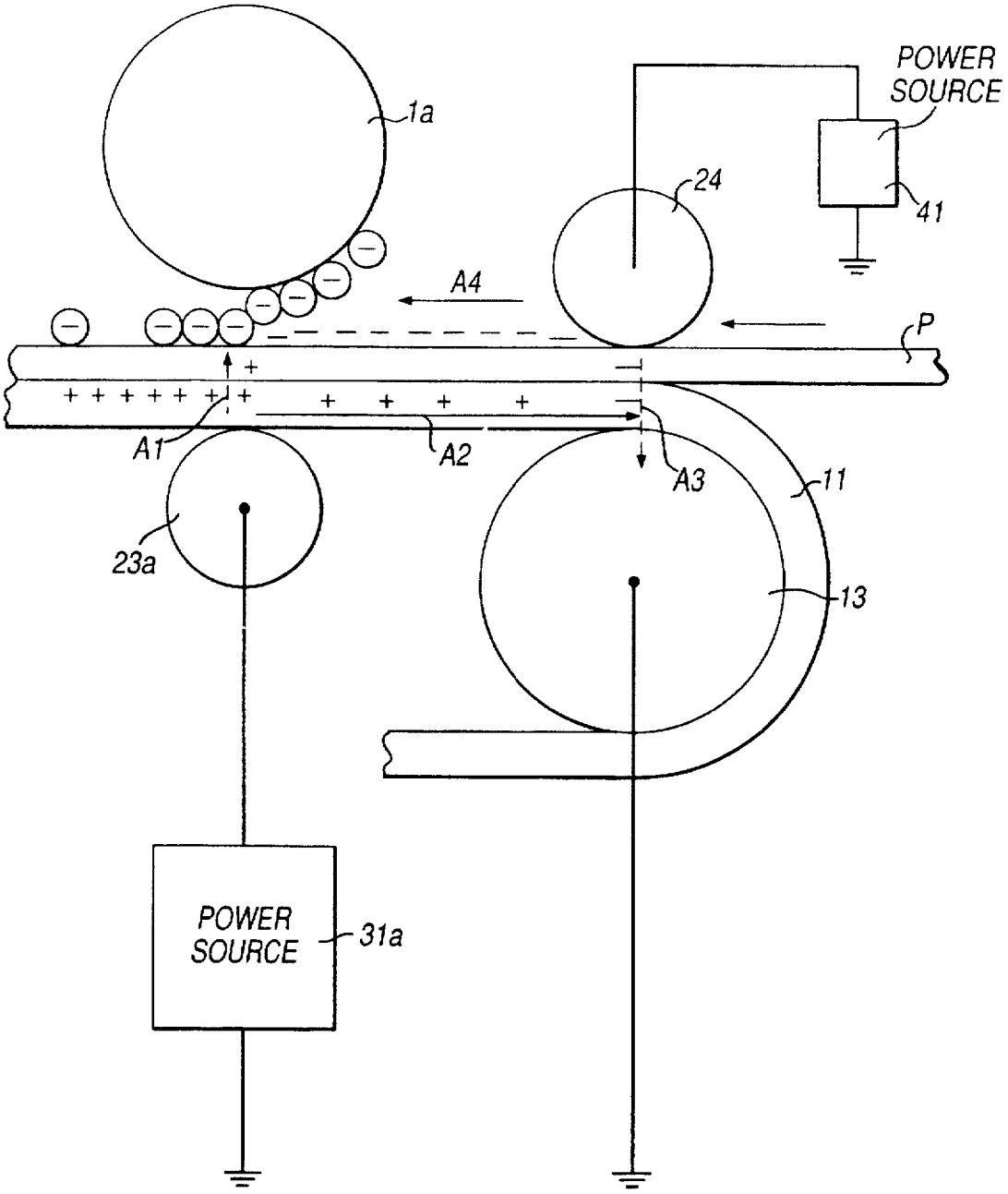
FIG. 6 is a schematic side view showing the flow of the electric charge at a first transfer stage.

The mechanism of the image transfer is as described above and as the transfer belt 11 uses a semiconductive belt, the discharged electric charge moves through the route as shown in FIG. 6.

That is, the routes are as shown by the charge moving routes A1 and A2. The electric charge flowing through the route A1 contributes to the actual image transfer and some of the charge leaks to the photosensitive drum 1*a* side and some remains on the transfer belt 11. The route A2 is for the current leaking to the grounded conductive support roller 13 via the surface (the inside) of the transfer belt 11. Here, as the route A2 does not at all contribute to the transfer operation, this route A2 may be said to be an unnecessary current route.

Here, the support roller 13 is required to be conductive to leak electric charge remaining on the transfer belt 11 which completed the transfer operation. Thus, this is an indispensable component part as the special discharging process had been eliminated.

So, for achieving the efficient image transfer, it is necessary to set "Current flowing through Route A1 larger than Current flowing through Route A2". Further speaking, it is necessary to set "Volume Resistance of Transfer Belt 11+Volume Resistance of Photosensitive Drum 1*a*" is smaller than "Surface Resistance of Transfer Belt 11".

Volume resistance of the transfer belt 11 used in the embodiment is $3\times10^{13}$ Ω.cm at normal temperature and humidity as shown in Table 1. As the thickness of the transfer belt 11 is 100 μm, the width of the transfer roller 23*a* contacting the transfer belt 11 is 200 mm, and the nip width of the transfer roller 23*a* contacting the transfer belt 11 is 2 mm, volume resistance becomes $7.5\times10^{10}$ Ω. Further, as to the contacting nip width of the transfer portion, the width contacting the photosensitive drum 1*a* was obtained by turning off a testing apparatus by force during the transfer operation and observing the state of an image.

Next, volume resistance of the photosensitive drum 1*a* was $2\times10^{14}$ Ω.cm which was obtained using a resistance measuring instrument manufactured by Mitsubishi Yuka Co., Ltd., Commodity Name: Hiresta, Model HRSS probe with 500 V applied and taken 10 seconds later.

So, when the resistance was calculated in the same manner as that for obtaining actual resistance of the transfer belt 11, it was $1\times10^{11}$ Ω (this value was calculated assuming that the contacting nip width of the transfer belt 11 with the photosensitive drum 1*a* is 2 mm and the film thickness of the photosensitive drum 1*a* is 20 μm). Therefore, the resistance between the transfer belt 11 and the photosensitive drum 1*a* in the volumetric direction is about $2\times10^{11}$ Ω.

Further, the surface resistance will be explained referring to FIG. 7.

The surface resistance of the transfer belt 11 is about $3\times10^{13}$ Ω/□ and a distance L from a point of the transfer roller 23*a* contacting the transfer belt 11 to a point of the support roller 13 contacting the transfer belt 11 is 52 mm. As the width of the transfer roller 23 contacting the transfer belt 11 is 200 mm, the resistance between the transfer roller 23*a* and the support roller 13 will be $$3\times10^{13}\ (\Omega/\square)/200\times52=7.8\times10^{12}\ \Omega$$

Therefore, as "Volume Resistance of Transfer Belt 11+Volume Resistance of Photosensitive Drum 1*a*=$2\times10^{11}$" is smaller than "Surface Resistance of Transfer Belt 11=$7.8\times10^{12}$ Ω", the transfer electric field will be formed effectively by the discharged electric charge. An actual image was a satisfactory image without causing the poor transfer.

Here, returning the discussion to FIG. 6, it is required to take the effect of the adsorbing roller 24 into consideration.

The adsorbing roller 24 also has a function to give the electric charge to the paper P so that the transfer belt 11 adsorbs it when bias voltage is applied.

At this time, the electric charge flows to the route A4 and through the paper P and the route A3 from where the charge leaks to the support roller 13. When considering the resistance component of the route A4, the surface resistance of the paper P is $2.2\times10^{11}$ Ω/□ at normal temperature and humidity as shown in Table 3 and a distance between the adsorbing roller 24 and the first transfer station (L1 shown in FIG. 7) is 52 mm. Further, as the adsorbing roller 24 is 200 mm wide, the surface resistance of the paper P will become $5.5\times10^{8}$ Ω.

Further, as the resistance of the photosensitive drum 1*a* is $1\times10^{11}$ Ω from the result of the calculation described above, the resistance of the surface on which current flows along the route A4 is nearly $1\times10^{11}$ Ω.

Further, the similar examination was conducted on the route A3. As the volume resistance of the paper P is $4.9\times10^{10}$ Ω.cm, the nip width of the adsorbing roller 24 with the paper P is 2 mm, the width of the adsorbing roller is 200 mm and the thickness of the paper P is 0.1 mm, the volume resistance of the paper P is $1.2\times10^{8}$ Ω. Further, as the volume resistance of the transfer belt 11 is $7.5\times10^{10}$ Ω as described above, the resistance in the direction where current flows along the route A3 is nearly $7.5\times10^{10}$ Ω.

Here, for the transfer process to be free from the effect of the adsorbing process, the routes A1 and A3 participating in respective processes should not be affected by the electric charge moving along the routes A2 and A3 so that they do not affect each other. When taking this into consideration, it is seen that the transfer process does not adversely affect the adsorbing process as the resistance ($7.8\times10^{12}$ Ω) participating in the route A3 is larger than the resistance ($2\times10^{11}$ Ω) participating in the route A1. Further, it is also seen that the adsorbing process does not adversely affect the transfer process as the resistance ($1\times10^{11}$ Ω) participating in the route A4 is larger than the resistance ($7.5\times10^{10}$ Ω) participating in the route A3.

Then, the carbon dispersed polycarbonate resin manufactured as the transfer belt 11 was evaluated. First, volume resistance and surface resistance of this transfer belt 11 were measured with the measuring instrument and according to the measuring method described above with the results as shown in Table 4.

TABLE 4

Environmental Dependency of Resistances of Carbon Dispersed Polycarbonate Transfer Belt

| | Environment | | |
|---|---|---|---|
| Resistance | 30° C., 85% RH | 21° C., 50% RH | 10° C., 20% RH |
| Surface resist. (Ω/□) | $9\times10^{8}$ | $8\times10^{8}$ | $4\times10^{8}$ |
| Volume resist. (Ω · cm) | $4\times10^{7}$ | $4\times10^{7}$ | $7\times10^{7}$ |

This Table 4 shows the measured data of resistances of the carbon dispersed polycarbonate transfer belt under respective environmental conditions. The discussion will be made on resistances under the environmental conditions of normal temperature and humidity (the results will be basically the same under other environmental conditions). As shown in Table 4, volume resistance is $4\times10^{7}$ Ω.cm.

The transfer belt 11 was 100 μm thick like a carbon dispersed polyimide transfer belt. Further, as the width of the transfer roller 23*a* contacting the transfer belt 11 was 200 mm and the nip width of the transfer roller 23*a* contacting the transfer belt 11 was 2 mm like the carbon dispersed polyimide transfer belt, the volume resistance will become $1\times10^{5}$ Ω.

Further, as the entirely same photosensitive drum 1*a* was used, the volume resistance of the photosensitive drum 1*a* is $1\times10^{11}$ Ω. So, the resistance between the transfer belt 11 and the photosensitive drum 1*a* in the volumetric direction is about $1\times10^{11}$ Ω. That is, it is seen that the resistance of the carbon dispersed polycarbonate transfer belt 11 is much smaller than the resistance of the photosensitive drum 1*a*.

Further, the surface resistance will be described referring to Table 4. The surface resistance of the transfer belt 11 is $8\times10^{8}$ Ω/□ and the transfer roller 23*a* is contacting the transfer belt 11, a distance L1 for the support roller 13 to contact the transfer belt 11 is 52 mm. As the width of the transfer roller 23*a* contacting the transfer belt 11 is 200 mm, the resistance between the transfer roller 23*a* and the support roller 13 will become as follows:

$$8\times10^{8}\ (\Omega/\square)/200\times52=2\times10^{8}\ \Omega$$

Accordingly, as "Volume Resistance of Transfer Belt 11+Volume Resistance of Photosensitive Drum 1*a*=$1\times10^{11}$ Ω" is larger than "Surface Resistance of Transfer Belt 11=$2\times10^{8}$ Ω", the discharged electric charge cannot form the transfer electric field effectively and flows to the conductive support roller 13. This was reflected in an actual image, causing the poor transfer. Further, the adsorbing motion became unstable due to a lot of electric charge flowing into the support roller 13.

Further, a similar phenomenon was generated in the fourth transfer station. This will be explained referring to FIG. 8.

The paper P is pinched between the transfer roller 23*d* and the photosensitive drum 1*d* together with the transfer belt 11. Under this state, the bias power source 31*d* was connected to the transfer roller 23*d*. The electric discharge was generated from the transfer roller 23*d* by the electric field formed by the transfer roller 23*d* and the photosensitive drum 1*d*. Discharge voltage (differing from discharge start voltage) at this time was 1,400 V.

Figure 8:
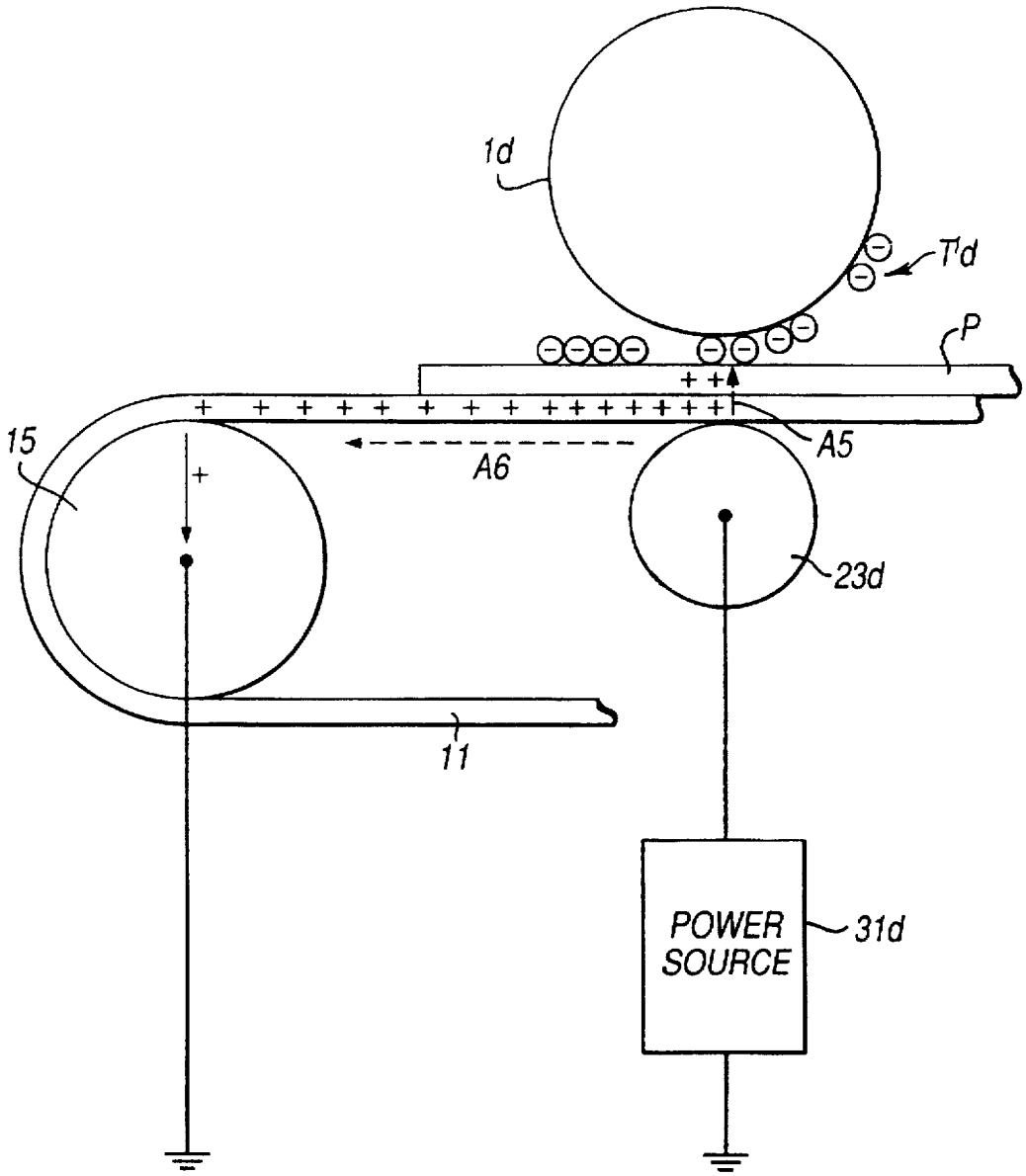
FIG. 8 is a schematic side view showing the flow of the electric charge at a last transfer stage.

As the discharge was generated, discharge current flows toward the photosensitive drum 1*d* side along the route A5 as shown in FIG. 8, that is, through the transfer belt 11 and the paper P. However, the electric charge remains on the transfer belt 11 as the resistance of the transfer belt 11 is as high as $10^{13}$ Ω.cm. By the electric field formed by this charge and the photosensitive drum 1*d*, a toner image Td' on the photosensitive drum 1*d* is electrostatically transferred onto paper P.

The mechanism of image transfer is as described above. As a semi-conductive belt was used as the transfer belt 11, the discharged electric charge flows through the route A6 shown in FIG. 8.

The electric charge flowing through the route A5 contributes to the actual image transfer and some of the charge leaks to the photosensitive drum 1*d* side and some remains on the transfer belt 11. The route A6 is for current leaking to the grounded conductive support roller 15 via the surface (inside) of the transfer belt 11. Here, the route A6 does not at all contribute to the transfer motion and this current is said to be unnecessary current.

Here, the support roller 15 is required to be conductive in order to leak electric charge remaining on the transfer belt 11 which completed the transfer operation. As the special discharging process was thus eliminated, the conductive support roller 15 is an indispensable component part. So, for the efficient image transfer, it is necessary to set "Current flowing along Route A5 larger than Current flowing along Route A6". Further speaking, it is needed to set "(Volume Resistance of Transfer Belt 11+Volume Resistance of Photosensitive Drum 1*d*) so as to become smaller than Surface Resistance of Transfer Belt 11".

The volume resistance of the transfer belt 11 used in the embodiment is $3.2\times10^{13}$ Ω.cm at normal temperature and humidity as shown in Table 1. As the thickness of the transfer belt 11 is 100 μm and the width of the transfer roller 23*d* contacting the transfer belt 11 is 200 mm and the nip width of the transfer roller 23*d* contacting the transfer belt 11 is 2 mm, the volume resistance becomes $7.5\times10^{10}$ Ω. Further, for the contacting nip width of the transfer portion, the width contacting the photosensitive drum was obtained by observing the image state with the test apparatus turned off by force during the transfer.

The volume resistance of the photosensitive drum 1*d* was $2\times10^{14}$ Ω.cm which was obtained from the resistance obtained 10 seconds after applying 500 V using the resistance measuring instrument manufactured by Mitsubishi Yuka Co., Ltd., Commodity Name: Hiresta, Model: HRSS probe.

So, when the resistance was calculated in the same method used for obtaining the actual resistance of the transfer belt 11, it was $1\times10^{10}$ Ω (calculated assuming that the contacting nip width between the transfer belt 11 and the photosensitive drum 1*d* is 2 mm). Therefore, the resistance in the volumetric direction between the transfer belt 11 and the photosensitive drum 1*d* is about $2\times10^{11}$ Ω.

Further, the surface resistance will be explained referring to FIG. 9. The surface resistance of the transfer belt 11 is about $3\times10^{13}$ Ω/□ and a distance L2 from the point of the transfer roller 23*d* contacting the transfer belt 11 to the point of the support roller 15 contacting the transfer belt 11 is 40 mm. As the width of the transfer roller 23*d* contacting the transfer belt 11 is 200 mm, the resistance between the transfer roller 23*d* and the support roller 15 will be as follows:

$$3\times10^{13}\ (\Omega/\square)/200\times40=6\times10^{12}\ \Omega$$

Accordingly, as "Volume Resistance of Transfer Belt 11+Volume Resistance of Photosensitive Drum 1*d*=$1\times10^{11}$" is smaller than "Surface Resistance of Transfer Belt 11=$6\times10^{12}$ Ω", the discharged electric charge forms the transfer electric field effectively. Actually, a satisfactory image was obtained for the fourth transferred image without causing the poor image transfer.

Then, a transfer belt made of polycarbonate resin with carbon dispersed manufactured for the transfer belt 11 was evaluated. First, volume resistance and surface resistance of this transfer belt 11 were measured using the measuring instrument and according to the method described above with the results as shown in Table 5.

TABLE 5

Environmental Dependency of Resistance of Carbon Dispersed Polycarbonate Transfer Belt

| Resistance | Environment | | |
|---|---|---|---|
| | 30° C., 85% RH | 21° C., 50% RH | 10° C., 20% RH |
| Surface resist. (Ω/□) | $9\times10^{8}$ | $8\times10^{8}$ | $4\times10^{8}$ |
| Volume resist. (Ω · cm) | $4\times10^{7}$ | $4\times10^{7}$ | $7\times10^{7}$ |

This Table 5 shows the measured data of resistances of the carbon dispersed polycarbonate transfer belt under various environmental conditions but the discussion will be made on resistances under normal temperature and humidity (the results will be basically the same under other environmental conditions). As shown in Table 5, the volume resistance of this transfer belt is $4\times10^{7}$ Ω.cm.

The transfer belt 11 was 10 μm thick like the carbon dispersed polyimide transfer belt. Further, the width of the transfer roller 23*d* contacting the transfer belt 11 was 200 mm and the nip width of the transfer roller 23*d* contacting the transfer belt 11 was 2 mm like the carbon dispersed polyimide transfer belt and therefore, the volume resistance will become $1\times10^{5}$ Ω.

Further, as the entirely same photosensitive drum 1*d* was used, the volume resistance of the photosensitive drum 1*d* is $1\times10^{10}$ Ω. Accordingly, the resistance in the volumetric direction of the transfer belt 11 and the photosensitive drum 1*d* is about $1\times10^{10}$ Ω. That is, it is seen that the resistance of the carbon dispersed polycarbonate transfer belt 11 is extremely smaller than that of the photosensitive drum 1*d*.

Further, the surface resistance will be explained referring to Table 4.

The surface resistance of the transfer belt 11 is $8\times10^{8}$ Ω/□ and a distance L2 from a point where the transfer roller 23*d* is contacting the transfer belt 11 to a point where the support roller 15 is contacting the transfer belt 11 is 40 mm. As the width of the transfer roller 23*d* contacting the transfer belt 11 is 200 mm, the resistance between the transfer roller 23*d* and, the support roller 15 will be as follows:

$$8\times1^{8}(\Omega/\square)/200\times40=1.6\times10^{8}\ \Omega$$

Accordingly, as "Volume Resistance of Transfer Belt 11+Volume Resistance of Photosensitive Drum 1*d*=$1\times10^{10}$ Ω" is larger than "Surface Resistance of Transfer Belt 11=$1.6\times10^{8}$ Ω", the discharged electric charge cannot form the transfer electric field effectively and flows to the conductive support roller 15. This was reflected in the actual image.

In other words, because of a poor transfer efficiency, even when the bias voltage applying condition was changed for the carbon dispersed polyimide transfer belt 11 having a volume resistivity $3.2\times10^{13}$ Ω.cm at normal temperature and humidity, the transfer efficiency was not improved, causing the poor image transfer. Furthermore, the bias power source 31*d* self stopped its function as overcurrent flowed to it.

From the above, it is seen that the resistance of the transfer belt 11 from the surface of the transfer roller 23*a* (23*d*), which is a transfer means, contacting the transfer belt 11, which is an image receiving medium conveying member to the surface of the support roller 13 (15) as another image receiving medium conveying member supporting/driving member contacting the transfer belt 11 is needed to be higher than the resistance from the surface of the transfer roller 23*a* (23*d*) to the photosensitive drum 1*a* (1*d*) as an image carrier.

Further, the present invention is not limited to the embodiment described above. For instance, the image receiving medium conveying belt 11 put and stretched in the flat state over the support rollers 13 and 15, which are the image receiving medium conveyer supporting/driving members has been described as the conveying means 10 in the above, however, the belt 11 may be installed in the drum shape.

Further, it is needless to say that the present invention is applicable in various many other forms without departing from the spirit and scope of the invention.

Figure 7:
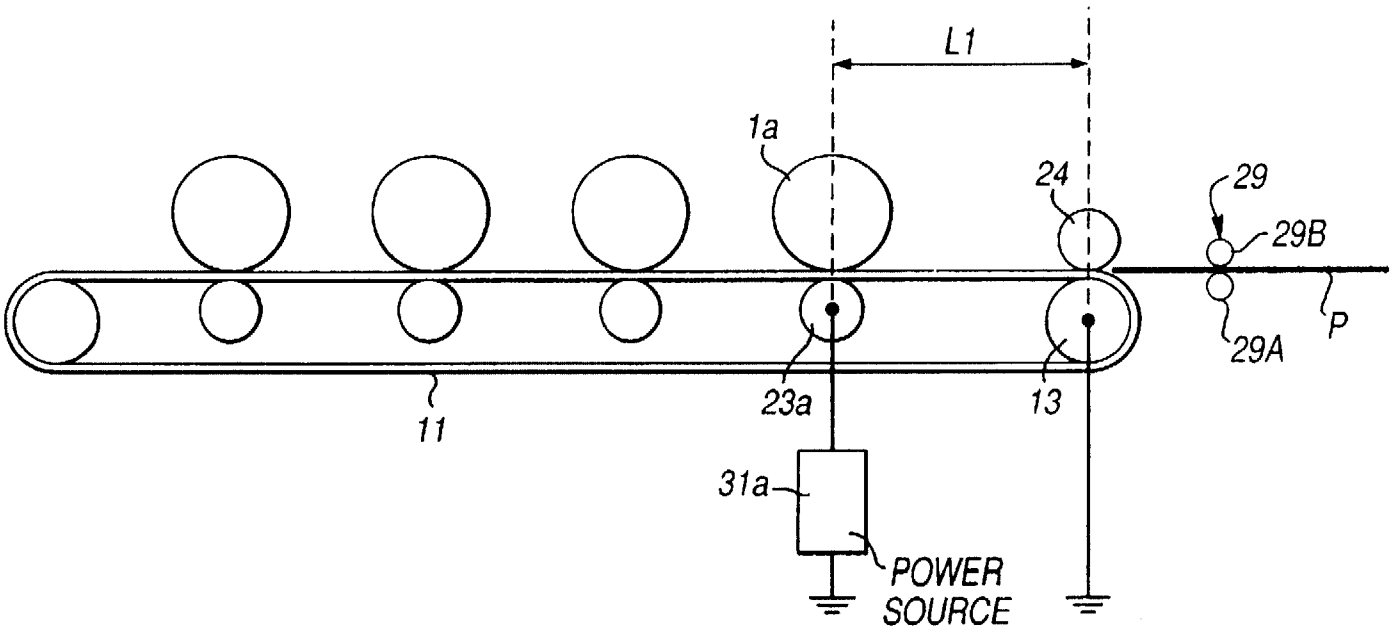
FIG. 7 is a schematic side view showing the arrangement of a first transfer stage and an adsorbing stage.
Figure 9:
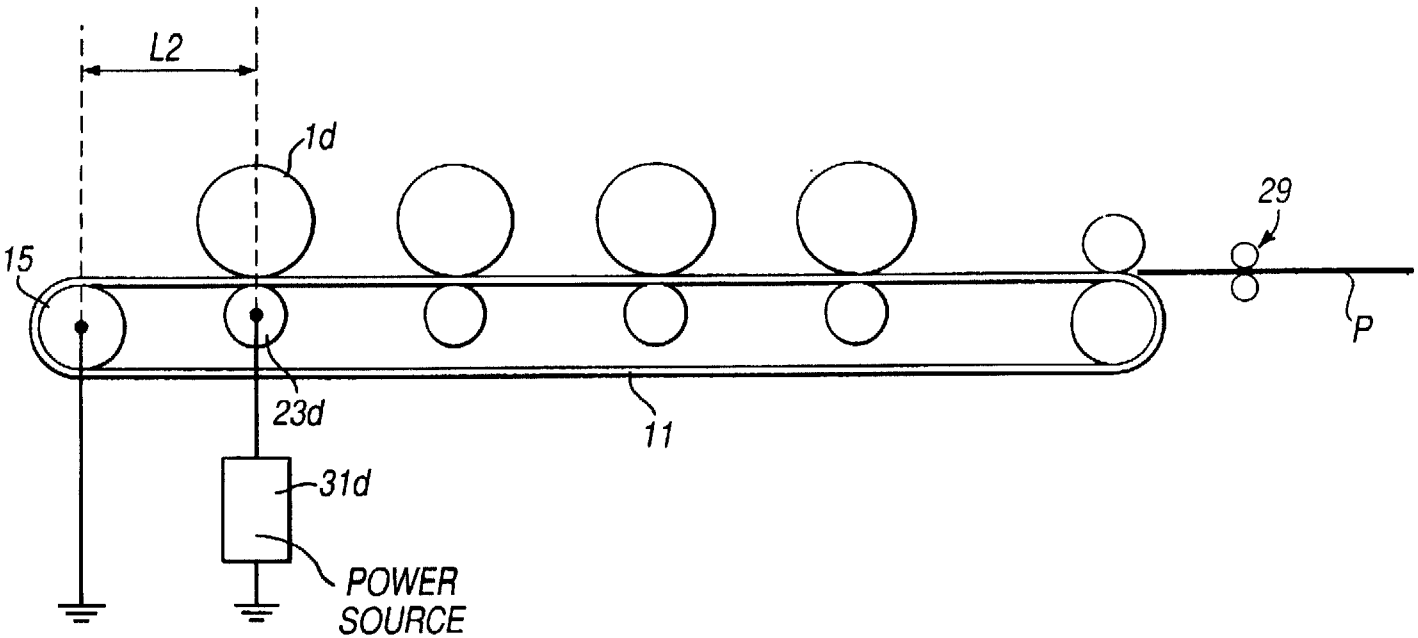
FIG. 9 is a schematic side view showing the positional relation between the last transfer stage and supporting rollers of the transfer belt.

For example, the embodiment shown in FIG. 7 and the embodiment shown in FIG. 9 may be combined to prevent drain of charge to the adsorbing means upstream of the paper conveying direction and to prevent drain of charge to the support member downstream of the paper conveying direction.

The present invention has the following effects as described in the above:

As a bias voltage applying means having the resistance $10^{4}$ to $10^{10}$ Ω has been adopted for applying the electric charge to the semi-conductive transfer belt, the satisfactory and stable image transfer becomes possible and the dielectric breakdown of the semi-conductive transfer belt can be prevented.

Further, as a bias voltage applying means having the resistance $10^4$ to $10^{10}$ Ω has been adopted for electrostatic adsorbing the image receiving medium to the semi-conductive transfer belt, the dielectric breakdown of the semi-conductive transfer belt can be prevented.

Furthermore, as the surface of the register rollers for sending the image receiving medium at a proper timing have been made dielectric, it becomes possible to stably adsorb the image receiving medium to the semi-conductive transfer belt under the humid environmental condition.

In addition, as the resistance between the surface of the image receiving medium conveying member contacting the adsorbing means and the surface contacting the image carrier is larger than the resistance between the transfer means and the image carrier, the stable adsorbing motion is assured without causing the unsatisfactory image transfer.

Further, when the resistance between the surface of the image receiving medium conveying member contacting the adsorbing means and the surface of another image receiving medium conveying member supporting/driving member contacting the image receiving medium conveying member is set higher than the resistance between the surface of the transfer means contacting the image receiving medium conveying member and the surface of the image carrier contacting the image receiving medium conveying member, the electric charge applied to the semiconductive transfer belt from the transfer charge applying means can be prevented from leaking to areas other than the transfer area through the semiconductive belt and the satisfactory and stable image transfer is assured without causing the unsatisfactory image transfer.

What is claimed is:

1. An image forming apparatus comprising:

means for forming a developed image on an image carrier;

means facing the image carrier for conveying an image receiving medium toward the image carrier;

means for electrostatically transferring the developed image onto the receiving medium conveyed by the conveying means by applying an electric charge through a back of the conveying means; and means, facing to the conveying means, for electrostatically adsorbing the image receiving medium to the conveying means, wherein electric resistance of the conveying means from a first position where the conveying means and the adsorbing means face each other to a second position where the conveying means and the image carrier face each other is larger than electric resistance between the image carrier and the transferring means.

2. An image forming apparatus according to claim 1, wherein the conveying means includes a pair of support rollers and a belt put over the pair of support rollers.

3. An image forming apparatus according to claim 2, wherein the belt has a thickness of 30–300 μm, a volume resistance of $10^8$–$10^{15}$ Ω.cm and a surface resistance of $10^8$–$10^{15}$ Ω/□.

4. An image forming apparatus according to claim 1, wherein the transferring means includes a conductive transfer roller and voltage supply means for supplying voltage to the transfer roller.

5. An image forming apparatus according to claim 1, wherein electric resistance of a portion where the transferring means contacts the conveying means is $10^4$–$10^{10}$ Ω.

6. An image forming apparatus according to claim 1, wherein electric resistance of a portion where the adsorbing means contacts the conveying means is $10^4$–$10^{10}$ Ω.

7. An image forming apparatus comprising:

a conveying member facing an image carrier on which a developed image is formed for conveying an image receiving medium toward the image carrier;

at least two support members, in contact with the conveying member, for supporting the conveying member to move the conveying member; and means in contact with the conveying member for electrostatically transferring the developed image onto the image receiving medium conveyed by the conveying member, wherein electric resistance of the conveying member from a first position where the transferring means is in contact with the conveying member to a second position where one of the support members is in contact with the conveying member is larger than electric resistance between the image carrier and the transferring means.

8. An image forming apparatus according to claim 7, wherein the conveying member includes a belt put on the support members.

9. An image forming apparatus according to claim 8, wherein the support members include a pair of support rollers arranged separately from each other.

10. An image forming apparatus according to claim 8, wherein the belt has a thickness of 30–300 μm, and a volume resistance of $10^8$–$10^{15}$ Ω.cm.

11. An image forming apparatus according to claim 7, wherein the transferring means includes a conductive transfer roller and voltage supply means for supplying voltage to the conductive transfer roller.

12. An image forming apparatus according to claim 7, wherein electric resistance of a portion where the transferring means contacts the conveying member is $10^4$–$10^{10}$ Ω.

13. An image forming apparatus comprising:

means for forming a first developed image on a first image carrier;

means for forming a second developed image on a second image carrier, the first and second image carriers being provided along a conveying direction;

means, facing the first and second image carriers, for conveying an image receiving medium to the first and the second image carriers in the conveying direction;

first transferring means, provided in contact with the conveying means at a back of the conveying means, for electrostatically transferring the first developed image onto the image receiving medium;

second transferring means, provided in contact with the conveying means at the back of the conveying means, for electrostatically transferring the second developed image onto the image receiving medium; and means, facing the conveying means, for electrostatically adsorbing the image receiving medium to the conveying means, wherein electric resistance of the conveying means from a first position where the conveying means and the adsorbing means face each other to a second position where the conveying means and the first image carrier face each other is larger than electric resistance between the first image carrier and the first transferring means.

14. An image forming apparatus according to claim 13, wherein the conveying means includes a first support member opposing the adsorbing means upstream of the first image carrier in a direction opposite said conveying direction, a second support member provided downstream of the second image carrier in said conveying direction, and a belt put over the first and second support members.

15. An image forming apparatus according to claim 14, wherein electric resistance of the belt from a position where the second transferring means is in contact with the belt to a position where the second support member is in contact with the belt is larger than electric resistance between the second image carrier and the second transferring means.

16. An image forming apparatus according to claim 15, wherein the belt has a thickness of 30–300 μm, a volume resistance of $10^8$–$10^{15}$ Ω.cm and a surface resistance of $10^8$–$10^{15}$ Ω/□.

17. An image forming apparatus according to claim 13, wherein the first and second transferring means include a conductive transfer roller and voltage supply means for supplying voltage to the conductive transfer roller, respectively.

18. An image forming apparatus according to claim 13, wherein electric resistance of a portion where the first and second transferring means contact the conveying means is $10^4$–$10^{10}$ Ω, respectively.

19. An image forming apparatus according to claim 13, wherein electric resistance of a portion where the adsorbing means contacts the conveying means is $10^4$–$10^{10}$ Ω.

20. An image forming apparatus comprising:

means for forming a developed image on an image carrier;

means facing the image carrier for conveying an image receiving medium toward the image carrier;

means for electrostatically transferring the developed image onto the image receiving medium conveyed by the conveying means by applying an electric charge through a back of the conveying means;

means, facing the conveying means, for electrostatically adsorbing the image receiving medium to the conveying means; and means for preventing movement of electric charge supplied by the transferring means from a first position where the conveying means and the image carrier face each other to a second position where the conveying means and the adsorbing means face each other and for allowing movement of electric charge from the transferring means to the image carrier.

21. An image forming apparatus according to claim 20, wherein electric resistance between the image carrier and the transferring means is total electrical resistance of that of the conveying means and that of the image carrier.

* * * * *